US006067996A

United States Patent [19]

Weber et al.

[11] Patent Number: 6,067,996

[45] Date of Patent: May 30, 2000

[54] NAIL DECORATION USING INK JETS

[75] Inventors: Paul J. Weber, Ft. Lauderdale, Fla.; Luiz B. Da Silva, Pleasanton, Calif.; Michael R. Weber, Clearwater, Fla.

[73] Assignee: Pearl I. LLC, Clearwater, Fla.

[21] Appl. No.: 09/366,610

[22] Filed: Aug. 3, 1999

Related U.S. Application Data

[63] Continuation-in-part of application No. 09/218,579, Dec. 22, 1998, Pat. No. 5,931,166.

[51] Int. Cl.[7] ..... A45D 29/00

[52] U.S. Cl. ..... 132/73; 132/200; 132/285; 700/161

[58] Field of Search ..... 132/73, 200, 285, 132/73.6, 75.3, 75.4, 73.5; 606/116, 2, 9, 10, 11; 128/898, 395, 398; 347/70, 71, 94, 68, 40; 700/161

[56] References Cited

U.S. PATENT DOCUMENTS

| | | | |
|---|---|---|---|
| 4,521,788 | 6/1985 | Kimura et al. | 347/68 |
| 4,575,805 | 3/1986 | Moermann et al. | 700/161 |
| 4,742,464 | 5/1988 | Duret et al. | 700/161 |
| 5,309,365 | 5/1994 | Sullivan et al. | 700/161 |
| 5,541,630 | 7/1996 | Ema et al. | 347/70 |
| 5,782,249 | 7/1998 | Weber et al. | 132/200 |
| 5,931,166 | 8/1999 | Weber et al. | 132/73 |

*Primary Examiner*—Gene Mancene
*Assistant Examiner*—Pedro Philogene

[57] ABSTRACT

Inkjet printing technology is used to apply a selected design on a fingernail or toenail. The nail printing device applies highly detailed, customized, multicolored designs that are scaled to the size and shape of the individual nail. The device comprises an ink jet print head; a holder for aligning the digit or nail, and a control system that contains the nail designs in an electronic digital form, scales and corrects the designs to the individual nail size and shape, and directs the ink jet print head to apply the scaled design to the nail.

20 Claims, 3 Drawing Sheets

NAIL DECORATION USING INK JETS

This application is a continuation-in-part of U.S. patent application Ser. No. 09/218,579, filed Dec. 22, 1998 now U.S. Pat. No. 5,931,166.

BACKGROUND OF THE INVENTION

1. Field of the Invention

The present invention relates to a device and method for decorating fingernails and toenails with customized, detailed, multicolored designs using inkjet printing technology.

2. Description of Related Art

The conventional decoration of fingernails and toenails involves the use of nail polishes, which are applied using a small brush. Decals or appliqués can be applied to the polished surface; these are typically affixed to the nail with glue or by the addition of a topcoat of clear polish. Airbrush painting through a stencil has been used to apply designs to nails. Artificial nails or nail tips applied to the natural fingernails are also used to provide decoration. U.S. Pat. No. 5,309,365 describes a system for cutting artificial nail tips and decorating them using automated cutting processes.

These conventional approaches for nail decoration can be time-consuming, labor intensive, and are limited to the type and quality of designs that are commercially available. There is a need for a device that can provide highly detailed, multicolored, customized nail designs and then rapidly apply the selected designs directly on natural fingernails or artificial nails.

SUMMARY OF THE INVENTION

The object of the present invention is to provide a device that applies a selected design on a fingernail or toenail using inkjet printing technology. The device applies customized, highly detailed, multicolored designs that are scaled to the size and shape of the individual nail. The device comprises an ink jet print head, a holder for maintaining the digit or nail in the proper position or alignment, and a control system that contains the nail designs in an electronic digital form, scales the designs to the individual nail size and shape, and causes the ink jet print head to apply the scaled design to the nail.

The ink jet print head may remain stationary while applying the design to the nail, but is typically translated over the nail while the digit is held stationary in the holder. Translation is typically in two directions (across the height and width of the nail), but the print head can also be translated in the vertical direction. The dimensions of the nail (length, width, height) can be measured by conventional means by the device operator and then input to the control system, which is typically a microprocessor. After the data is input, either manually or electronically, the control system forms a two- or three-dimensional map of each nail.

The nail designs are stored in electronic (i.e., digital) form in the control system and are manipulated electronically by software to scale the design (i.e., reduce and/or enlarge the design) in one, two, or three dimensions to fit the individual nail. Some designs are pre-made, entered into the control system, and can be viewed on a display monitor for selection by the subject. These pre-made designs may be altered electronically, according to the subject's taste, before the designs are applied. For a customized design, the subject may provide the design or image in an electronic form or in a form that can be scanned and converted into an electronic form that is fed into the control system.

To apply the design to the nail, the digit or digits are placed in the holder and positioned. The pre-selected design in the control system is scaled to fit the individual nail. The ink jet print head is connected to and controlled by the control system, which sends a signal to the print head. The print head contains an array of ink jet nozzles, which fire the ink at points on the nail as directed by the control system. If the print head is scanned, then the control system directs it to scan across the nail in two or three directions and print the desired design on the nail. Ink jet printing technology is well-known and commercially available.

Other objects and advantages of the present invention will become apparent from the following description and accompanying drawings.

BRIEF DESCRIPTION OF THE DRAWINGS

The accompanying drawings, which are incorporated into and form part of this disclosure, illustrate embodiments of the invention and together with the description, serve to explain the principles of the invention.

DETAILED DESCRIPTION OF THE INVENTION

The object of the present invention is to provide a device that applies a selected design on a fingernail or toenail using inkjet printing technology. The device applies highly detailed, customized, multicolored designs that are scaled to the size and shape of the individual nail. The device comprises an ink jet print head, a holder for aligning the digit or nail, and a control system (with software) that contains the nail designs in an electronic digital form, scales the designs to the individual nail size and shape, and directs the ink jet print head to apply the scaled design to the nail.

The ink jet print head may remain stationary while printing the design on the nail, but is typically translated over the nail while the digit is held stationary in the holder. The translation is typically in two directions—across the height and width of the nail. The print head can also be translated in the vertical direction, along the depth (or height) of the nail. This vertical translation is beneficial for printing high resolution images, particularly with highly contoured nail surfaces. In an alternative embodiment, the holder with the digit could translate in two or three directions under a stationary print head.

Figure 1:
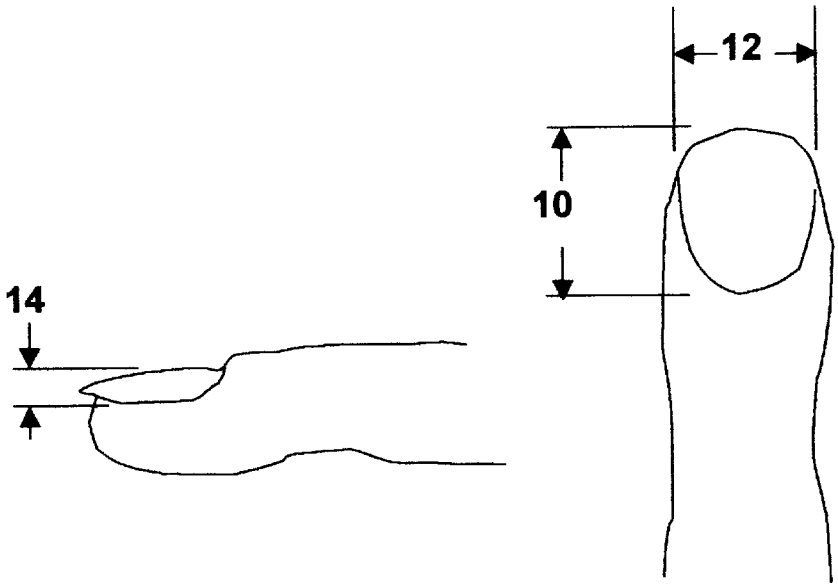
FIG. 1 shows the dimensions of a nail to be printed.

The dimensions of the nail (length, width, depth or height) are shown in FIG. 1. The length 10 is measured from the cuticle to the tip or end of the nail; width 12 is measured laterally across the nail. The height or depth 14 of the nail is measured from the highest point (typically the middle) to the lowest point (typically the sides). The dimensions can be measured by conventional means (e.g., ruler, micrometer) by the device operator, who then manually inputs the dimensions to the control system, which is typically a microprocessor with associated software. In an alternative embodiment, the nail dimensions are acquired electronically, such as using a computer digitizer board or an optical system. An example of an optical system in which the digit is placed in a holder and the nail dimensions are acquired by the optical system, which feeds the output to the control system electronically, is described in U.S. Pat. No. 5,931,166, Application Ser. No. 09/218,579, which is hereby incorporated by reference.

After the data is input either manually or electronically, the control system creates a two- or three-dimensional map or grid of each nail. If the curvature of the nail (i.e., the shape from the middle of the nail to the sides) is acquired electronically, then the control system can create a three-dimensional map based on that data. However, if the exact curvature of the nail is not known, then the system software can use the length, width and optionally the height (depth) information and a given nail shape or curvature that corresponds to an "average" nail (e.g., semicircular, parabolic, semi-elliptical) to create the three-dimensional map. The operator may be prompted by the control system software to select one of a limited number of shapes (e.g., highly curved, slightly curved) based on visual observations to provide a gross estimate that is sufficient to produce a good printed image on the nail.

The nail designs are stored in electronic (e.g., digital) form in the control system and are manipulated electronically to scale the design (i.e., reduce, enlarge) in one, two, or three dimensions to fit the individual nail. The control system corrects for the curvature of the nail to optimize the appearance of the nail image. Basically, the two-dimensional image may seem distorted, but the final image printed on a highly contoured, three-dimensional nail does not appear stretched or distorted.

Some nail designs can be pre-made and entered into the control system, where they can be viewed on a display monitor connected to the control system for selection by the subject. These designs may include holiday images and common symbols such as flags, flowers, animals, celestial objects, astrological symbols, initials, cartoon characters, logos of sport teams, and famous works of art. Even the pre-made designs can be altered electronically somewhat in form or different colors selected, according to the subject's taste, before the designs are applied.

For a customized design, the subject may provide the design or image in an electronic form or in a form that can be scanned and converted into an electronic form that is fed into the control system. These personalized designs can include photographs of people or scenery, logos of local teams, and names.

Figure 2:
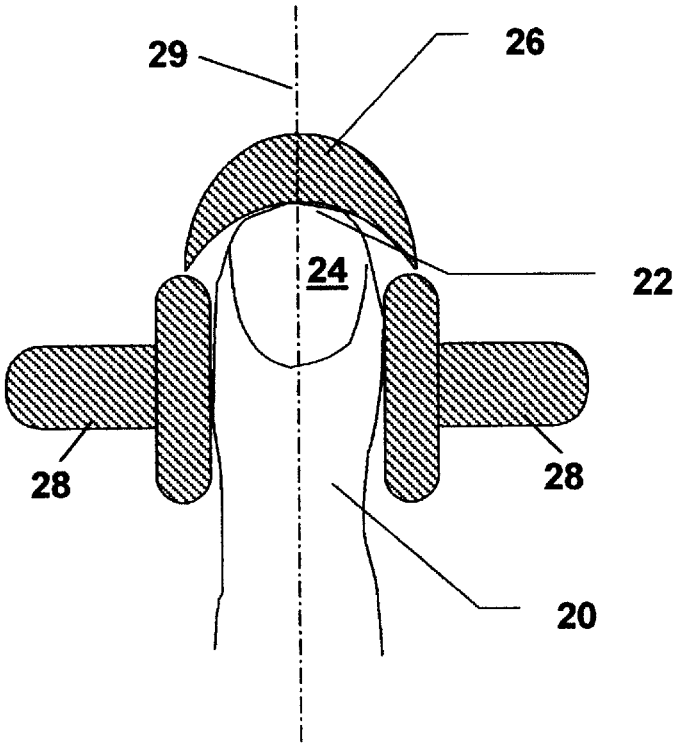
FIG. 2 shows a top view of a nail in a holder in the nail printing device.

To apply the design to the nail, the digit or digits are placed in the holder and positioned so that each nail or digit tip touches a reference surface or point and is centered. FIG. 2 shows a finger 20 with the tip 22 of the nail 24 touching a reference surface 26. The nail 24 is centered using centering means 28. The centering means 28 may be moveable blunt-ended pins that are connected such that movement of either pin toward or away from the centerline 29 of the holder automatically moves the other pin the same distance. Other mechanisms are known in the art for achieving automatic centering of the digit and nail. The vertical position of the nail can also be adjusted in a similar manner by translating the holder until the top surface of the nail is at another reference position.

Figure 3:
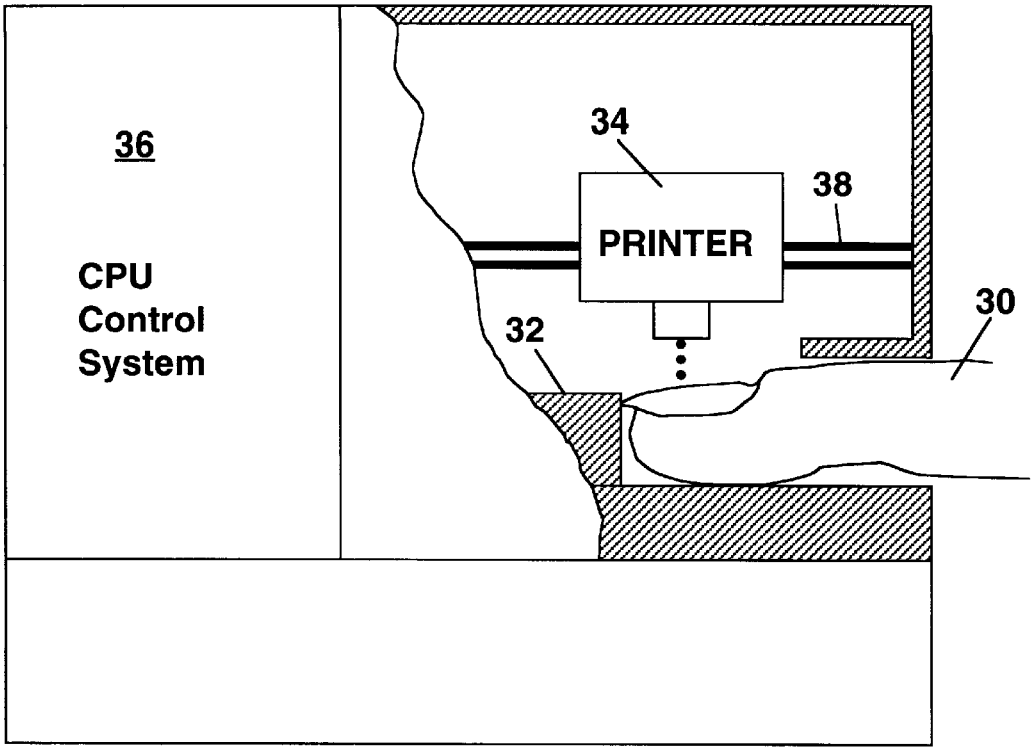
FIG. 3 shows a side view of a nail printing device according to the present invention.

FIG. 3 shows a side view of a nail decoration device according to the present invention. The digit 30 is placed in the holder 32 and aligned as discussed above. An ink jet print head 34 is connected to and controlled by the control system 36, which is integrally connected to the holder 32 and print head 34 in this embodiment. After the pre-selected design in the control system 36 is scaled to fit the individual nail, the control system (and associated software) 36 sends a signal to the print head 34, causing it to apply or print the desired design on the nail.

If the print head 34 is large enough, then the print head 34 does not need to be scanned. Alternatively, the device includes scanning means 38 that permit the print head 34 to scan across the nail in one, two, or three directions. Translating in the vertical direction keeps the nail surface a given distance from the ink jet nozzles in the print head at all times and may improve the resolution of the printed design. However, using software that corrects for the nail curvature is a preferred approach to scanning in three directions. Scanning mechanisms are known in the art and are used in commercially available ink jet printers.

Figure 4:
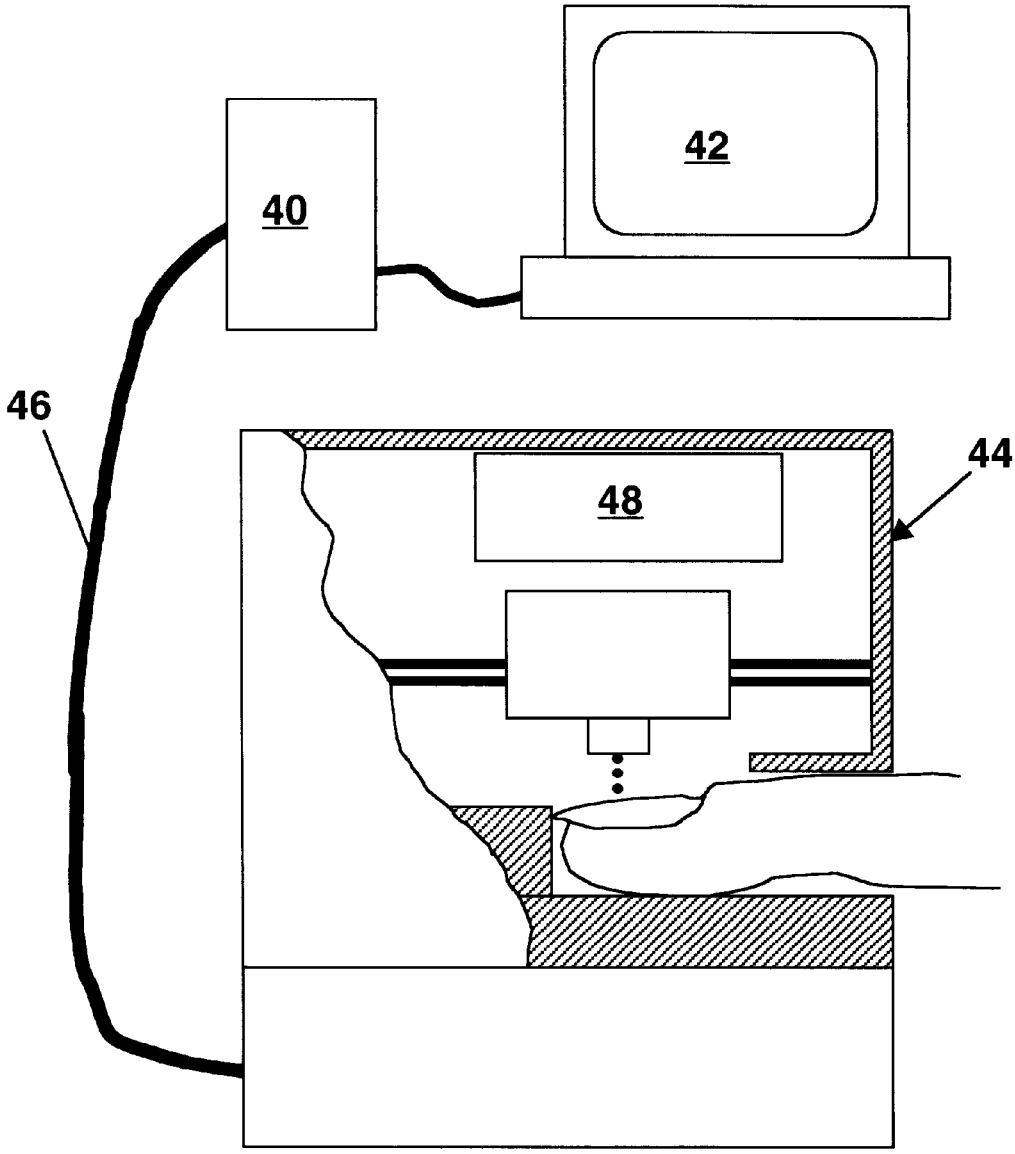
FIG. 4 shows an alternative embodiment of the nail printing device according to the present invention.

In an alternative embodiment shown in FIG. 4, the control system 40 (i.e., microprocessor and associated software) and display monitor 42 may be remote from the nail printing device 44 and connected by cables 46.

The nail decoration device may have a single holder and print head, such that one nail at a time is printed. Alternatively, the digit holder can hold two or more nails and be configured so that the print head translates over two or more nails during a printing cycle or can quickly move to another nail without repositioning the hand or foot. The device permits different designs to be applied quickly to all ten digits, if desired.

Ink jet printing technology is well-known, and ink jet printers are readily available. The ink jet print head contains an array of ink jet nozzles connected to ink chambers, which fire the ink at points on the nail as directed by the control system. The ink jets can be piezoelectric, magnetoelectric, or thermal. For the present application, the print head can be a relatively small array of nozzles and provide a small dot size for high resolution designs. If the print head is not scanned, then the array of nozzles must be large enough to cover large nails.

The inks must be rapid drying and typically are black, cyan, magenta, and yellow. Special fluorescent inks are available that could be used for glow-in-the-dark designs. The wet design may be dried under drying means 48 if needed, such as a heat lamp or blower. The dryer may be integrally connected to the nail printing device, as shown in FIG. 4, so that the nail does not need to be moved or repositioned if multiple printing cycles by the print head are used.

A pre-coat that improves ink absorption and protects or conditions the natural nail may be applied to the nails before printing the design, either using the ink jets or by conventional means. The pre-coat may also provide a more desirable background color for the printed design. The pre-coat or primer may include anti-fungal or anti-bacterial agents to prevent fungal and other infections that can form on the nail; these agents may also be added to the inks that are used in the design.

An overcoat, preferably clear, may be applied to the printed design to protect it from scratches and damage. The overcoat may be applied using another printing cycle of the print head or by conventional means.

Although the present description has focused on applying the ink jet designs to natural nails, it can readily be appreciated that the designs may be applied to artificial nails, before or after being affixed to the natural nails.

The above descriptions and illustrations are only by way of example and are not to be taken as limiting the invention in any manner. It is obvious that one skilled in the art can substitute known equivalents for the structures and means described. The full scope and definition of the invention, therefore, is set forth in the following claims.

What is claimed is:

1. A nail printing apparatus for applying a selected design to a nail, comprising:

a holder for positioning at least one nail;

an ink jet print head for applying the design to the nail positioned in the holder; and a control system for storing the design and controlling the application of the design by the ink jet print head.

2. The apparatus as recited in claim 1, wherein the control system scales the design to fit the length and width of the nail.

3. The apparatus as recited in claim 1, further comprising scanning means for translating the print head over the nail in at least one direction.

4. The apparatus as recited in claim 3, wherein the scanning means translates the print head in at least two directions.

5. The apparatus as recited in claim 3, further comprising centering means connected to the holder for aligning the nail.

6. The apparatus as recited in claim 1, wherein the control system scales the design to correct for curvature of the nail.

7. The apparatus as recited in claim 1, further comprising optical means for determining the length and width of the nail, wherein the length and width are input electronically to the control means.

8. The apparatus as recited in claim 1, further comprising drying means for drying the design after application.

9. The apparatus as recited in claim 1, further comprising scanning means for translating the holder in at least one direction.

10. A method for applying a selected design to a nail, comprising:

positioning the nail in the holder;

scaling the selected design to fit at least one dimension of the nail; and applying the scaled design to the nail positioned in the holder using an ink jet print head.

11. The method as recited in claim 10, wherein scaling the design comprises scaling the design in the dimensions of length and width.

12. The method as recited in claim 10, wherein scaling the design comprises scaling the design to correct for the curvature of the nail.

13. The method as recited in claim 10, wherein applying the design is carried out by scanning the print head over the nail.

14. The method as recited in claim 10, wherein applying the design is carried out by scanning the print head over the nail in at least two directions.

15. The method as recited in claim 10, further comprising determining the dimensions of the nail and manually inputing the dimensions into a control system.

16. The method as recited in claim 10, further comprising determining the dimensions of the nail and electronically inputing the dimensions into a control system.

17. The method as recited in claim 10, wherein applying the design is carried out by scanning the nail under the print head.

18. The method as recited in claim 10, further comprising actively drying the design on the nail.

19. The method as recited in claim 10, further comprising applying a pre-coat to the nail before applying the design.

20. The method as recited in claim 10, further comprising applying an overcoat to the nail after applying the design.

* * * * *